US006801635B1

(12) United States Patent
Minami et al.

(10) Patent No.: US 6,801,635 B1
(45) Date of Patent: Oct. 5, 2004

(54) SPEAKER DEVICE

(75) Inventors: Hideki Minami, Kanagawa (JP); Hachishiro Kobayashi, Tokyo (JP); Toshio Hirosawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 304 days.

(21) Appl. No.: 09/857,954

(22) PCT Filed: Oct. 6, 2000

(86) PCT No.: PCT/JP00/07002

§ 371 (c)(1),
(2), (4) Date: Sep. 4, 2001

(87) PCT Pub. No.: WO01/28279

PCT Pub. Date: Apr. 19, 2001

(30) Foreign Application Priority Data

Oct. 14, 1999 (JP) ..... 11-292917

(51) Int. Cl.[7] ..... H04R 25/00
(52) U.S. Cl. ..... 381/406; 381/401; 381/396
(58) Field of Search ..... 381/400–402, 381/406–410, 420–422, 412, 414, 396, 433

(56) References Cited

U.S. PATENT DOCUMENTS 4,151,379 A * 4/1979 Ashworth ..... 381/402
6,373,958 B1 * 4/2002 Enomoto et al. ..... 381/406

FOREIGN PATENT DOCUMENTS

JP 64-37195 3/1989
JP 5-56497 3/1993

OTHER PUBLICATIONS

Patent Abstract of Japan PCT/JP00/07002 (WO 01 28279) szamu nemzetkozi ujdonsagkutatasi jelentes masolatat!

Sipos Gy.: Hangsugarzok epitese (Radiotechnika evkonyve 1991.; Budapest, 1990.; 42–56. es 87.o; 28–33. es 35. abrak).

* cited by examiner

*Primary Examiner*—Curtis Kuntz
*Assistant Examiner*—P. Dabney
(74) *Attorney, Agent, or Firm*—Frommer Lawrence & Haug LLP; William S. Frommer

(57) ABSTRACT

A speaker device for supplying output from an amplifier to a plurality of loud speakers through a dividing network, wherein a network coil constituting the dividing network is wound in a groove in the outer circumferential surface of a cover of a driving part of the loudspeaker. Thereby, the network coil need not be mounted on a terminal plate or the like of a speaker box as a separate part.

5 Claims, 7 Drawing Sheets

SPEAKER DEVICE

TECHNICAL FIELD

The present invention relates to a speaker device, and particularly relates to a speaker device for vibrating a diaphragm in response to an electrical signal to produce sound.

BACKGROUND ART

A loudspeaker is widely used as a conversion means for converting an electrical signal into the sound. In particular, a dynamic speaker is designed so that a voice coil wound about a bobbin is disposed within a gap of a magnetic circuit constituting a driving means, the vibration in a direction of axis received by the voice coil is transmitted to the diaphragm, whereby the vibration in response to the electrical signal is produced by the diaphragm to produce the sound in response to the electrical signal.

It is difficult for such a loudspeaker to reproduce a low sound to a high sound evenly. Thus, generally, a plurality of loudspeakers are combined. For example, a loudspeaker for a low sound and a loudspeaker for a high sound constitute a speaker device. Accordingly, output from an amplifier is supplied to the respective loudspeakers through a dividing network comprising a plurality of filters, and a reproducing band is divided by the dividing network.

Such a dividing network as described comprises a combination of filters such as a lowpass filter, a bandpass filter, a highpass filter and so on, and is constituted by a combination of an inductance coil and a condenser. A coil for such filters as described, that is, a network coil is mounted, as a part separately from the loudspeaker, in a predetermined position of the speaker device.

For example, as shown in FIG. 1, a loudspeaker 1 is mounted so as to close an aperture of a baffle plate 3 on the front surface side of a speaker box 2, a terminal plate 5 is mounted on a rear cover 4, and a network coil 6 is mounted internally of the terminal plate 5.

In the conventional speaker device as described above, the network coil is formed from a single independent part, and the filter coil is formed from a combination of a coil and a condenser to divide a band of an electric signal supplied to the corresponding loudspeaker. The conventional network coil is an air-core coil, which is mounted on the terminal plate 5, as shown in FIG. 1, for example.

The mounting as described above poses a problem that when magnetic metal such as iron is present nearby, the inductance changes under the influence thereof. Further, since the network coil is used as a single part, the number of parts increases when the speaker device is assembled.

DISCLOSURE OF THE INVENTION

The present invention has been accomplished in view of the problem as noted above. It is an object of the present invention to provide a speaker device adapted to wind and mount a network coil about a loudspeaker.

According to the present invention, there is provided a speaker device for vibrating a diaphragm in response to an electrical signal to produce sound, wherein a network coil is wound about a driving part for vibrating a diaphragm.

The driving part comprises a magnetic circuit, and a voice coil disposed in an air gap of the magnetic circuit, and the network coil may be wound about the outer peripheral portion of the magnetic circuit. Further, the device may be designed so that a cover is mounted so as to cover the magnetic circuit, a groove is formed around in the outer circumferential surface of the cover, and the network coil is wound about within the groove. Further, the network coil may constitute a core of the network coil. Further, the network coil may be wound about so as to be located around the plate of the magnetic circuit. Furthermore, the cover is formed of a magnetic material, and the network coil may be wound about the outer circumferential surface of the cover. Moreover, the cover is formed of a synthetic resin, a ring formed of a magnetic material is mounted on the cover, and the network coil may be wound about externally of the ring.

According to the present invention, the network coil is mounted to be wound about the driving part for vibrating the diaphragm, and a filter is constituted by the network coil to restrict the band of a signal supplied to the loudspeaker.

BEST MODE FOR CARRYING OUT THE INVENTION

The speaker device according to the present invention will be described hereinafter with reference to the drawings. The speaker device to which the present invention is applied is designed so that a network coil is wound about a cover mounted so as to cover the circumference of a magnetic circuit of a loudspeaker. Particularly, a groove is formed around in the outer circumferential surface of the cover, and the network coil is wound about a part of the groove. It is to be noted that this embodiment is provided for better understanding of the present invention, and the present invention is not limited to this embodiment.

It is possible to selectively adjust the network coil into an air-core coil and a core coil by adjusting a clearance between the cover about which the network coil is wound and the magnetic circuit. It is also possible to adjust the inductance of the coil by providing the groove in the cover so as to be located externally of the plate of the magnetic circuit, winding the coil about the portion of the groove, and adjusting the gap between the plate and the cover.

In a magnetic-proof type loudspeaker in which a magnetic circuit of a loudspeaker is covered with a cover formed of a magnetic material, for example, such as iron, it may be designed so that a network coil is wound directly about the outer circumferential surface of the cover formed of a magnetic material, and the cover constitutes a core. Alternatively, the cover is molded of a synthetic resin, and a ring formed of a magnetic material such as ferrite is embedded or mounted internally of a position in which a network coil is wound to thereby enable the adjustment of inductance of the coil.

According to the speaker device in which the network coil is wound about the outer circumference of the cover of the driving part of the loudspeaker, since in a speaker device that likely has restrictions on mounting positions, a loudspeaker and a network coil can be put together, it is not necessary that the network coil be assembled as a separate part, and in addition, a mounting means for mounting a network coil and a space are not necessary.

Figure 1:
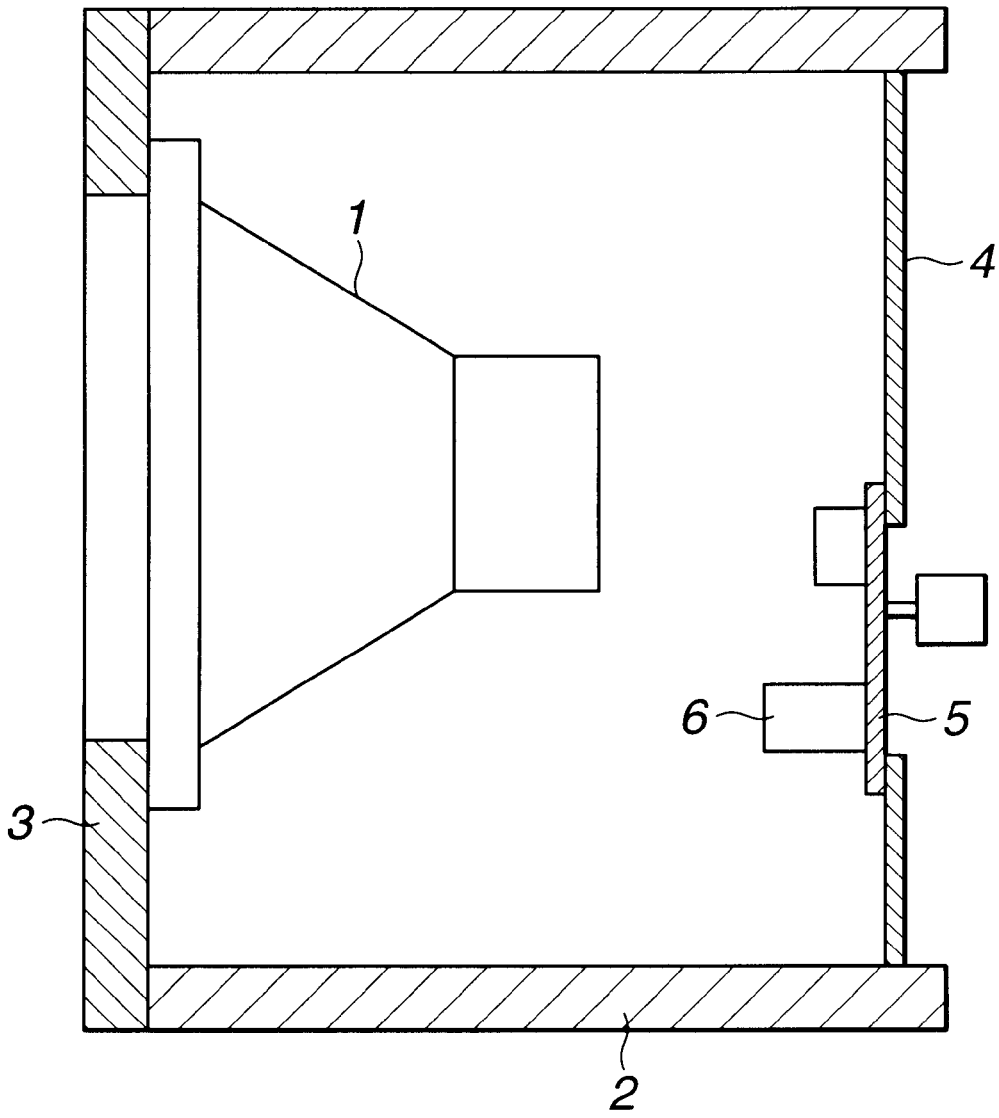
FIG. 1 is a longitudinal sectional view of a speaker box showing a mounting of a network coil in prior art.
Figure 2:
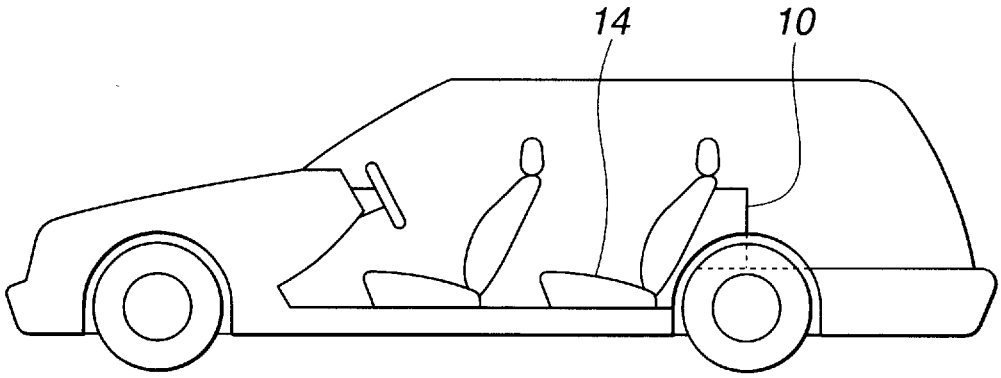
FIG. 2 is a side view of the interior of a station wagon showing a mounting of a loudspeaker.
Figure 3:
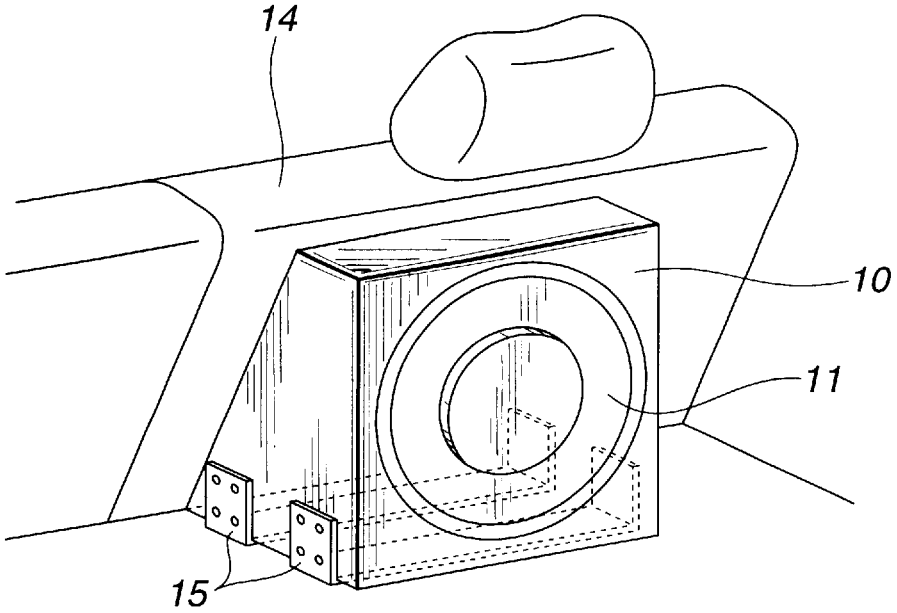
FIG. 3 is a perspective view of main parts showing a mounting of a speaker box.

FIG. 2 is a side view of the interior of a station wagon showing a mounting of a loudspeaker, and FIG. 3 is a perspective view of main parts showing a specific mounting form of a speaker box.

The speaker device according to this embodiment is a speaker device to be loaded on the vehicle loaded on an automobile, as shown in FIG. 2, and comprises, as shown in FIG. 3, a speaker box 10, and a loudspeaker 11 having a large aperture held in the speaker box 10. It is noted that the speaker box 10 is mounted through metal fittings 15 at the rear of a rear seat 14 of a station wagon, as shown in FIG. 3, for example.

Figure 4:
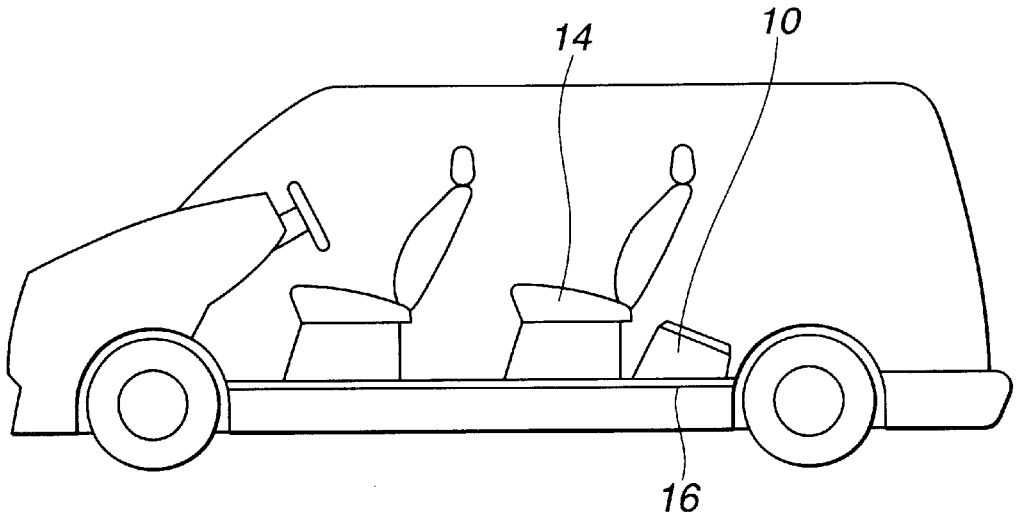
FIG. 4 is a side view of the interior of a cargo vehicle showing a mounting of a speaker box.
Figure 5:
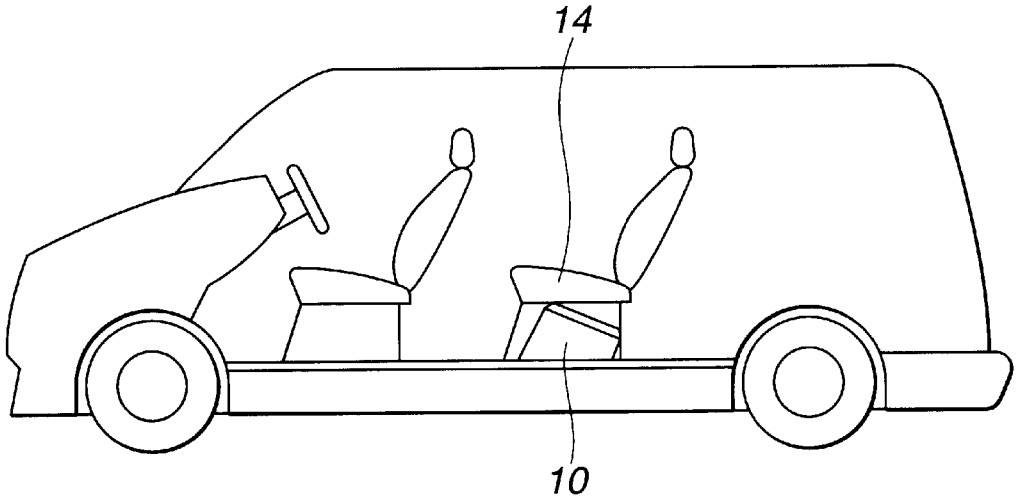
FIG. 5 is a side view of a mini-van showing a mounting of a speaker box.

It is to be noted that the position of mounting the speaker box 10 is not always limited to such a position, and the speaker box 10 may be mounted at a suitable position within the automobile. For example, as shown in FIG. 4, the speaker box 10 may be mounted on a floor panel 16 at the rear of a rear seat 14 of a cargo vehicle. Alternatively, the speaker box 10 may be mounted below the rear seat 14 of a minivan, as shown in FIG. 5, for example.

Figure 6:
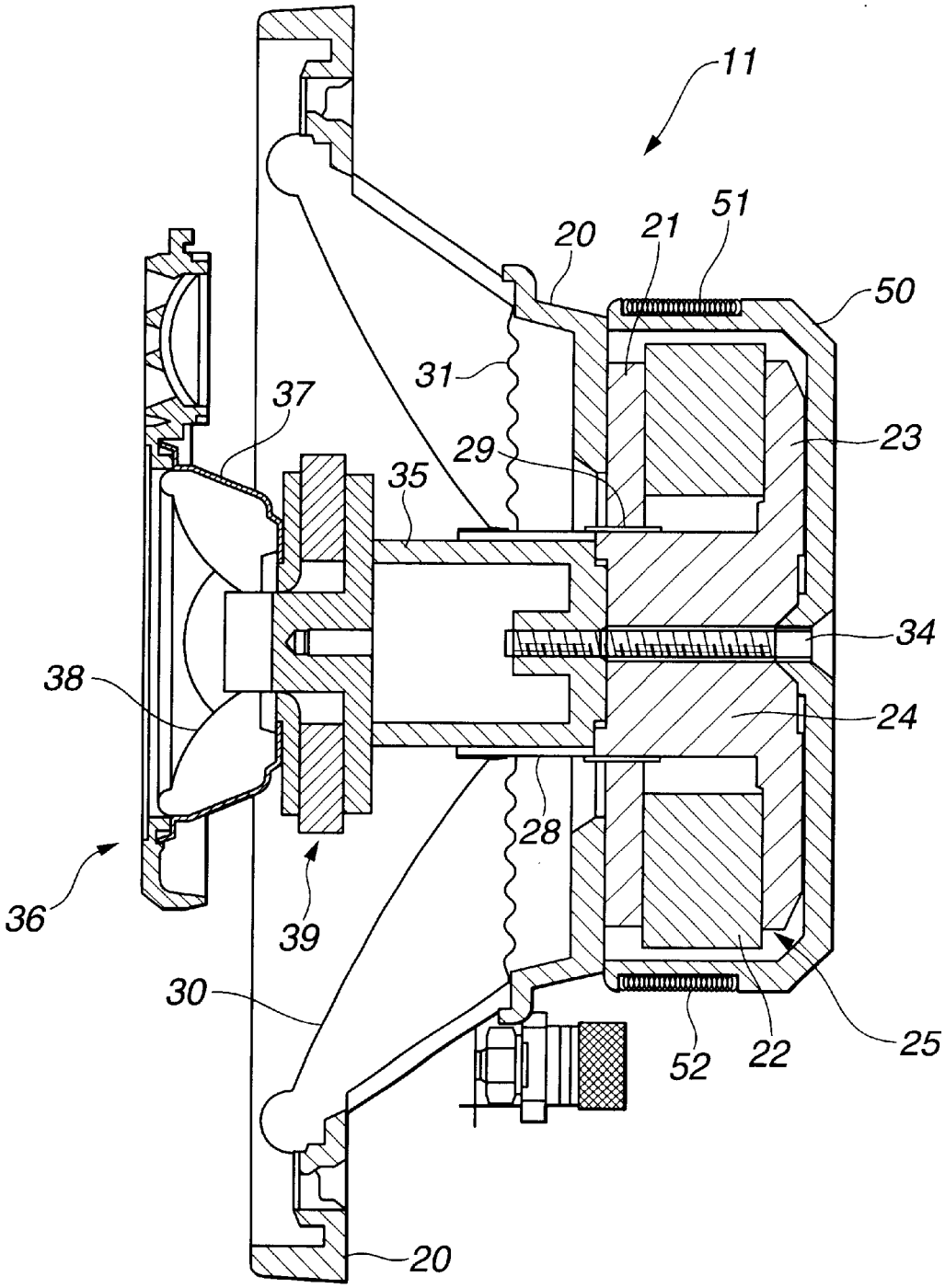
FIG. 6 is a longitudinal sectional view showing a construction of a loudspeaker.

Next, the construction of the loudspeaker to be loaded on the vehicle as described above will be explained with reference to FIG. 6. The loudspeaker 11 is provided with, as shown in FIG. 6, a frame 20. A plate 21 of which center part is open is secured on the proximal end side of the frame 20. On the rear side of the plate 21 is disposed a ring-like magnet 22 formed from a permanent magnet. On the rear side of the magnet 22 is secured a yoke 23. A pole piece 24 is provided, on the yoke 23, so as to be projected toward the center part thereof.

A bobbin 28 is disposed in an air gap between the outer peripheral surface of the pole piece 24 and the inner peripheral surface of the plate 21. A voice coil 29 is wound about the bobbin 28. The bobbin 28 is connected to a diaphragm 30, and a damper 31 having a concentric zigzagged pattern is connected between the part of the bobbin 28 on the center side of the diaphragm 30 and the part of the bobbin 28 of the frame 20 side.

Figure 10:
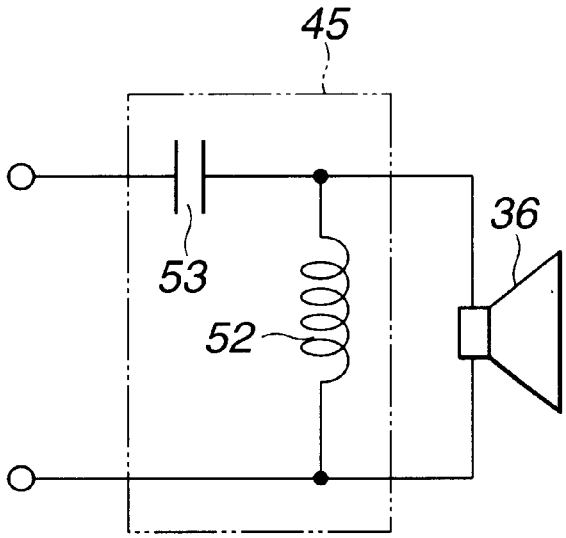
FIG. 10 is a circuit diagram of a filter.
Figure 11:
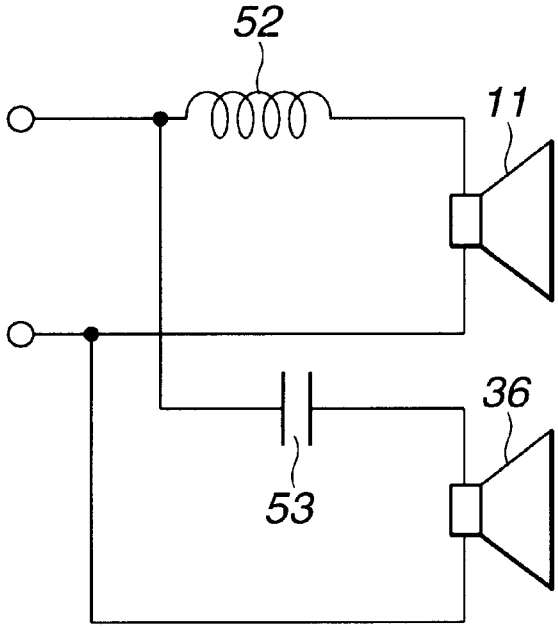
FIG. 11 is a circuit diagram of a further filter.

Further, in the loudspeaker 11, a network coil 52 is wound about the driving part 25 for driving the diaphragm 30. More specifically, a cover 50 is mounted around the driving part 25, a groove 51 is formed around in the outer circumferential direction of the cover 50, and a network coil 52 is wound about within the groove 51. Such a network coil 52 as described constitutes a filter along with a condenser 53, as shown in FIG. 10 or FIG. 11, for example, to select bands with respect to a plurality of loudspeakers 11 and 36.

Further, a support bracket 35 is secured by means of a screw 34 to the extreme end of a pole piece 24 of the loudspeaker 11, and a loudspeaker 36 for a high sound is mounted on the extreme end of the support bracket 35. The construction of the loudspeaker 36 for a high sound is substantially the same as that of the loudspeaker 11, and is a size smaller than the latter. That is, the loudspeaker 36 for a high sound is provided with a frame 37, and a diaphragm 38 is disposed internally thereof, the diaphragm 38 being driving by a driving part 39.

In the loudspeaker 11 described above, when a current flows into the voice coil 29 disposed in the air gap of the magnetic circuit comprising the magnet 22, the yoke 23, the pole piece 24, and the plate 21, the bobbin 28 about which the voice coil 29 is wound receives force in a direction of axis thereof accordingly, by which force the bobbin 28 moves in a direction of axis, that is, in a lateral direction in FIG. 6. This movement is transmitted to the diaphragm 30 connected with the bobbin 28, whereby the diaphragm 30 vibrates in response to an electrical signal to produce the sound. When the driving part 39 of the loudspeaker 36 for a high sound causes the diaphragm 38 to vibrate by operation similar to the above, the loudspeaker 36 generates the sound.

Figure 7:
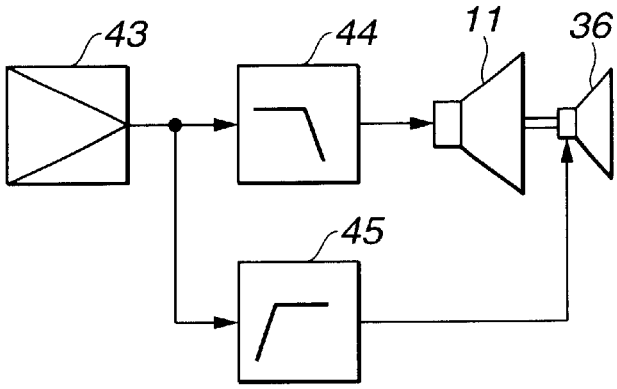
FIG. 7 is a block diagram of a circuit showing the connection of a network system.

Next, the constitution of a dividing network of the speaker device comprising a pair of loudspeakers 11 and 36 as described will be explained. The dividing network of the speaker device comprises, for example, as shown in FIG. 7, a lowpass filter 44 and a highpass filler 45, and output of an amplifier 43 is supplied to the loudspeakers 11 and 36 through these filters 44 and 45. That is, a signal on the lowpass side is supplied to the loudspeaker 11 by the lowpass filter 44, and a signal on the highpass side is supplied to the loudspeaker 36 for a high sound by the highpass filter 45.

Figure 8:
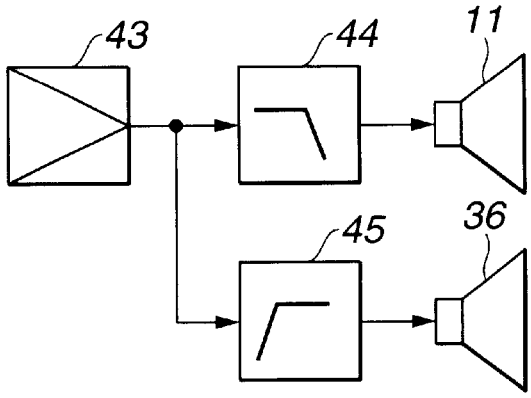
FIG. 8 is a block diagram of a circuit showing the connection of a further network system.

A speaker device shown in FIG. 8 is designed so that in the constitution as mentioned above, the loudspeakers 11 and 36 are mounted separately from each other, and the loudspeaker 36 for a high sound is arranged at a position different from the loudspeaker for a low sound 11.

Figure 9:
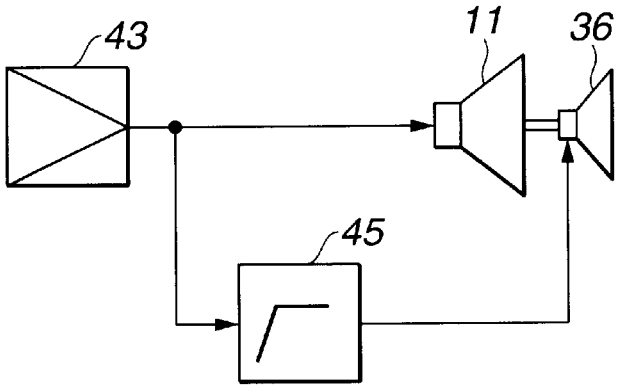
FIG. 9 is a block diagram of a circuit showing the connection of another network system.

In a speaker device shown in FIG. 9, the dividing network is constituted merely by the highpass filter 45. That is, output of an amplifier 43 is supplied directly to the loudspeaker for a low sound 11. Here, the loudspeaker for a low sound 11 reproduces mainly a low sound by the aid of its own band characteristics. On the other hand, the loudspeaker for a low sound 36 takes partial charge of reproduction of mainly a high sound on the highpass side by a signal supplied through the highpass filter 45.

FIG. 10 is a view showing a definite circuit constitution of the highpass filter 45 shown in FIG. 7, FIG. 8 or FIG. 9. The highpass filter 45 comprises a network coil 52 and a condenser 53. The network coil 52 constituting the highpass filter 45 is wound within the groove 51 formed in the outer circumferential surface of the cover 50 of the loudspeaker 11, as mentioned above. Accordingly, the terminal of the network coil 52 is connected to the terminals of the condenser 53 and the loudspeaker 36.

FIG. 11 is a view showing a further circuit constitution of the dividing network. In this circuit constitution, the network coil 52 whose impedance increases as the frequency becomes high is connected in series with the loudspeaker for a low sound 11, whereas the condenser 53 whose impedance increases as the frequency becomes low is connected in series with the loudspeaker for a high sound 36. Accordingly, the band is substantially divided by the circuit comprising the network coil 52 and the condenser 53, whereby the low sound is mainly reproduced by the loudspeaker for a low sound 11, and the high sound is mainly reproduced by the loudspeaker for a high sound 36.

As described above, the network coil 52 constituting the dividing network is wound within the groove 51 formed in the outer circumferential surface of the cover 50 of the driving part of the loudspeaker 11, whereby the network coil 52 and the loudspeaker 11 can put together, thus eliminating mounting members for mounting the network coil 52 as a separate part, and a space therefor. Further, since the network coil 52 is also mounted together by the mounting of the loudspeaker 11, the number of assembling steps for the speaker device can be reduced.

Figure 12:
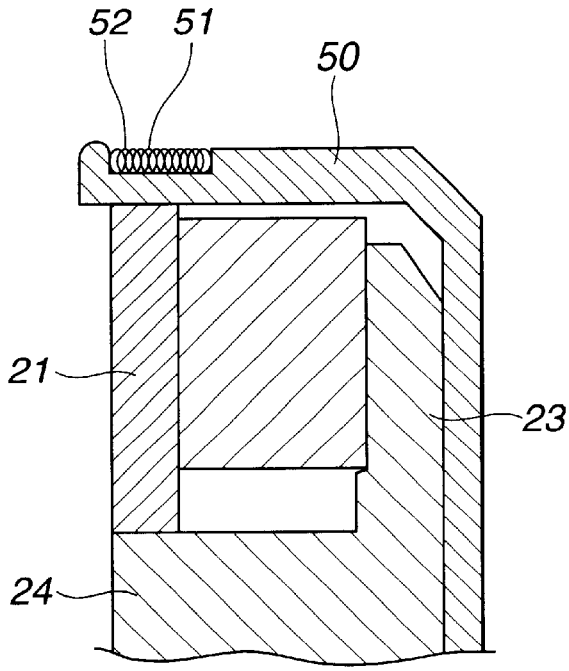
FIG. 12 is a longitudinal sectional view of main parts of a driving part in a second embodiment.

FIG. 12 is a view showing the constitution of a further embodiment of the loudspeaker loaded on a vehicle 11. In this embodiment, as shown in FIG. 12, the plate 21 of the magnetic circuit extends outward so as to come into contact with the inner circumferential surface of the cover 50, as a consequence of which the plate 21 constitutes a core of the network coil 52. The position at which the network coil 52 is wound substantially corresponds to the position at which the plate 21 and the cover 50 come into contact with each other. That is, the cover 50 is formed of a magnetic material such as iron to provide a magnetic-proof loudspeaker, and the network coil 52 is wound about the outer circumferential surface of the cover 50 of the magnetic-proof loudspeaker.

Figure 13:
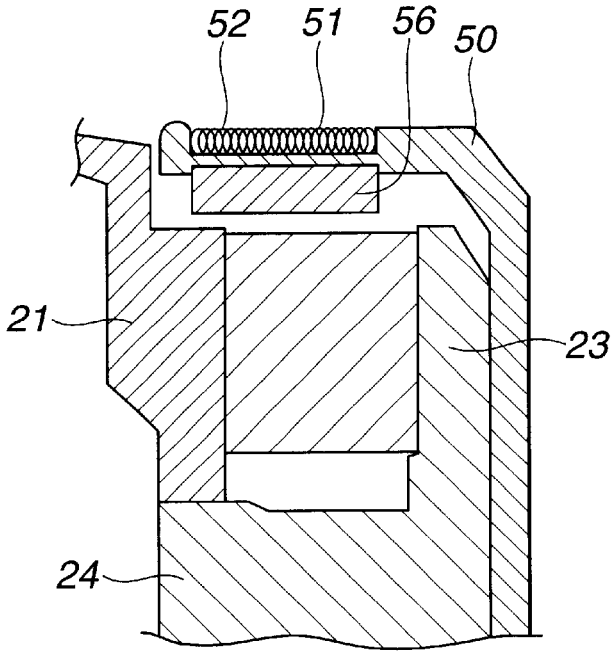
FIG. 13 is a longitudinal sectional view of main parts of a driving part in a third embodiment.

FIG. 13 is a view showing the constitution of another embodiment of the loudspeaker loaded on a vehicle 11. In this embodiment, the cover 50 is formed of a synthetic resin, for example, such as ABS resin, and a ring 56 formed of ferrite is secured to a position internally of the cover 50 and at which the network coil 52 is wound. Accordingly, the ring 56 made of ferrite constitutes a core of the network coil 52. The inductance of the network coil is adjusted by the ring 56 made of ferrite.

INDUSTRIAL APPLICABILITY

According to the present invention, there is provided a speaker device for vibrating a diaphragm in response to an electrical signal to produce the sound, wherein a network coil is wound about a driving part for vibrating the diaphragm. According to such a speaker device as described, the network coil is wound about the driving part, and the loudspeaker and the network coil can be put together, and when the speaker device is assembled, the number of assembling parts can be reduced. That is, mounting members for mounting the network coil and the space therefor are eliminated. Further, since the network coil need not be mounted as a separate part, the number of assembling steps can be reduced.

What is claimed is:

1. A speaker device for vibrating a diaphragm in response to an electrical signal to produce sound, comprising:

a magnetic circuit comprised of a magnet, a plate and a yoke;

a drive portion comprised of said magnetic circuit and a voice coil;

a cover that covers said drive portion; and a dividing network coil wound about a perimeter portion of said cover for dividing a frequency band of an input signal.

2. The speaker device according to claim 1 wherein a groove is formed around on the outer circumferential surface of said cover, and said dividing network coil is wound within said groove.

3. The speaker device as in claim 1 wherein said dividing network coil is wound so as to be located in the circumference of a plate of said magnetic circuit.

4. The speaker device according to claim 1 wherein said cover is formed of a magnetic material, and said dividing network coil is wound about the outer circumferential surface of said cover.

5. The speaker device as in claim 1 wherein said cover is formed of a synthetic resin, a ring formed of a magnetic material is mounted inside said cover, and said dividing network coil is wound externally of said cover.

* * * * *